United States Patent [19]

Dragone et al.

[11] 4,203,105

[45] May 13, 1980

[54] SCANABLE ANTENNA ARRANGEMENTS CAPABLE OF PRODUCING A LARGE IMAGE OF A SMALL ARRAY WITH MINIMAL ABERRATIONS

[75] Inventors: Corrado Dragone, Little Silver; Michael J. Gans, Monmouth Beach, both of N.J.

[73] Assignee: Bell Telephone Laboratories, Incorporated, Murray Hill, N.J.

[21] Appl. No.: 906,737

[22] Filed: May 17, 1978

[51] Int. Cl.[2] ..... H01Q 19/13

[52] U.S. Cl. ..... 343/781 P; 343/779; 343/840; 343/837

[58] Field of Search ..... 343/781 CA, 781 R, 781 P, 343/779, 837, 839, 840

[56] References Cited

U.S. PATENT DOCUMENTS

| | | | |
|---|---|---|---|
| 3,500,427 | 3/1970 | Landesman et al. | 343/836 |
| 3,755,815 | 8/1973 | Stangel et al. | 343/100 |
| 3,775,769 | 11/1973 | Heerem et al. | 343/100 |
| 3,821,746 | 6/1974 | Mizusawa et al. | 343/781 CA |

OTHER PUBLICATIONS

W. D. Fitzgerald, "Limited Electronic Scanning With an Offset Feed Near-Field Gregorian System", Technical Report 486 of the Lincoln Laboratory (MIT), Sep. 24, 1971.

Y. Mizugutch, "Offset Dual Reflector Antenna", AP-5 International Symposium U. of Mass. Session 1, Oct. 11-15, 1976.

*Primary Examiner*—David K. Moore

*Attorney, Agent, or Firm*—Erwin W. Pfeifle

[57] ABSTRACT

The present invention relates to antennas which have reflector arrangements that produce a large image with minimal aberrations at the exit aperture thereof of a small feed array. In the present arrangement, the feed array is placed at the conjugate plane relative to the exit aperture of a geometrically confocal reflector system comprising a parabolic main reflector and a parabolic subreflector so that exact imaging of the array is obtained at the exit aperture. In such arrangements, alignment and surface accuracy errors of the various reflectors can be easily corrected by appropriately changing the phase or the position of the associated elements of the feed array. A three-reflector arrangement having sequential geometric confocality is disclosed which also alters the focal length of the main reflector sufficiently to permit the inclusion of polarization and/or frequency diplexing means in the overall reflector system.

8 Claims, 8 Drawing Figures

SCANABLE ANTENNA ARRANGEMENTS CAPABLE OF PRODUCING A LARGE IMAGE OF A SMALL ARRAY WITH MINIMAL ABERRATIONS

BACKGROUND OF THE INVENTION

1. Field of the Invention

The present invention relates to scanable offset antenna arrangements which produce at the exit aperture thereof a large image of a small feed array with minimal aberrations and, more particularly, to scanable offset antenna arrangements wherein a main parabolic reflector and a subreflector are disposed coaxially to achieve both paraxial and geometric surface confocality while positioning the feed array at the conjugate plane relative to the exit aperture of the reflector system.

2. Description of the Prior Art

Limited scanning offset feed antenna arrangements have been devised for, inter alia, radar systems and now also suggested for satellite communication systems both for the antennas of the ground stations and those of the satellite. One such arrangement is disclosed in U.S. Pat. No. 3,500,427, issued to S. Landesman et al on Mar. 10, 1970 where the arrangement comprises a panel of radiating elements capable of scanning through an angle and an offset reflector system comprising a parabolic main reflector and an elliptical subreflector for producing a high gain. The reflectors are described as substantially confocal with the panel of radiating elements being disposed at one foci of the elliptical subreflector to compensate for abberations in the optical system. The reflectors, however, are not geometrically confocal in that the focus of the paraboloid main reflector does not coincide with either of the foci of the elliptical subreflector. As a consequence, a plane wave incident on the paraboloid main reflector in the direction of its axis is not transformed into a plane wave after two reflections and the feed array illumination can be considered to be a plane wave only in the vicinity of the array center.

Another scanable offset antenna arrangement is disclosed in the publication entitled "Limited Electronic Scanning with an Offset-Feed Near-Field Gregorian System" by W. D. Fitzgerald in Technical Report 486 of the Lincoln Laboratory (MIT), Sept. 24, 1971. There, a near-field Gregorian antenna is disclosed which uses offset confocal and coaxial sectional paraboloid reflectors and a relatively small planar-array feed.

Although the various prior art arrangements have rays which converge to a common focus between the two reflectors for producing wavefronts after each reflection which gives very limited imaging of the feed array, such arrangements generally introduce spherical aberrations and provide planar wavefronts over only very small portions of the aperture or scan angle. Additionally, in such arrangements phase aberrations are improved by generally shaping the subreflector to reduce imperfections in the main reflector. The problem remaining in the prior art, therefore, is to provide an antenna arrangement which provides both substantially improved phase characteristics and imaging without requiring specially designed subreflectors or highly accurate surface geometries in the main reflector and subreflector to be used.

BRIEF SUMMARY OF THE INVENTION

The problem remaining in the prior art has been solved in accordance with the present invention which relates to scanable offset antenna arrangements which produce at the exit aperture thereof a large image of a small feed array with minimal aberrations and, more particularly, to scanable offset antenna arrangements wherein a main parabolic reflector and a subreflector are disposed coaxially to achieve both paraxial and geometric surface confocality while positioning the feed array at the conjugate plane relative to the exit aperture of the reflector system.

It is an aspect of the present invention to provide a confocally and coaxially disposed main parabolic reflector and parabolic subreflector with the feed array positioned at the conjugate plane relative to the exit aperture of the reflector system to provide perfect imaging and aberrations free performance.

It is a further aspect of the present invention to permit a planar wave at the aperture of the reflector system to be seen as a flat planar image at the feed array and to permit imperfections in the main reflector or the subreflectors, which give rise to a corresponding field distortion in the plane of the feed array, to be compensated for by a change in phase on a one-to-one basis at the feeds of the array associated with rays impinging such imperfections, rather than by reshaping a reflector of the antenna system.

Other and further aspects of the present invention will become apparent during the course of the following description and by reference to the accompanying drawings.

BRIEF DESCRIPTION OF THE DRAWINGS

Referring now to the drawings, in which like numerals represent like parts in the several views.

DETAILED DESCRIPTION

Figure 1:
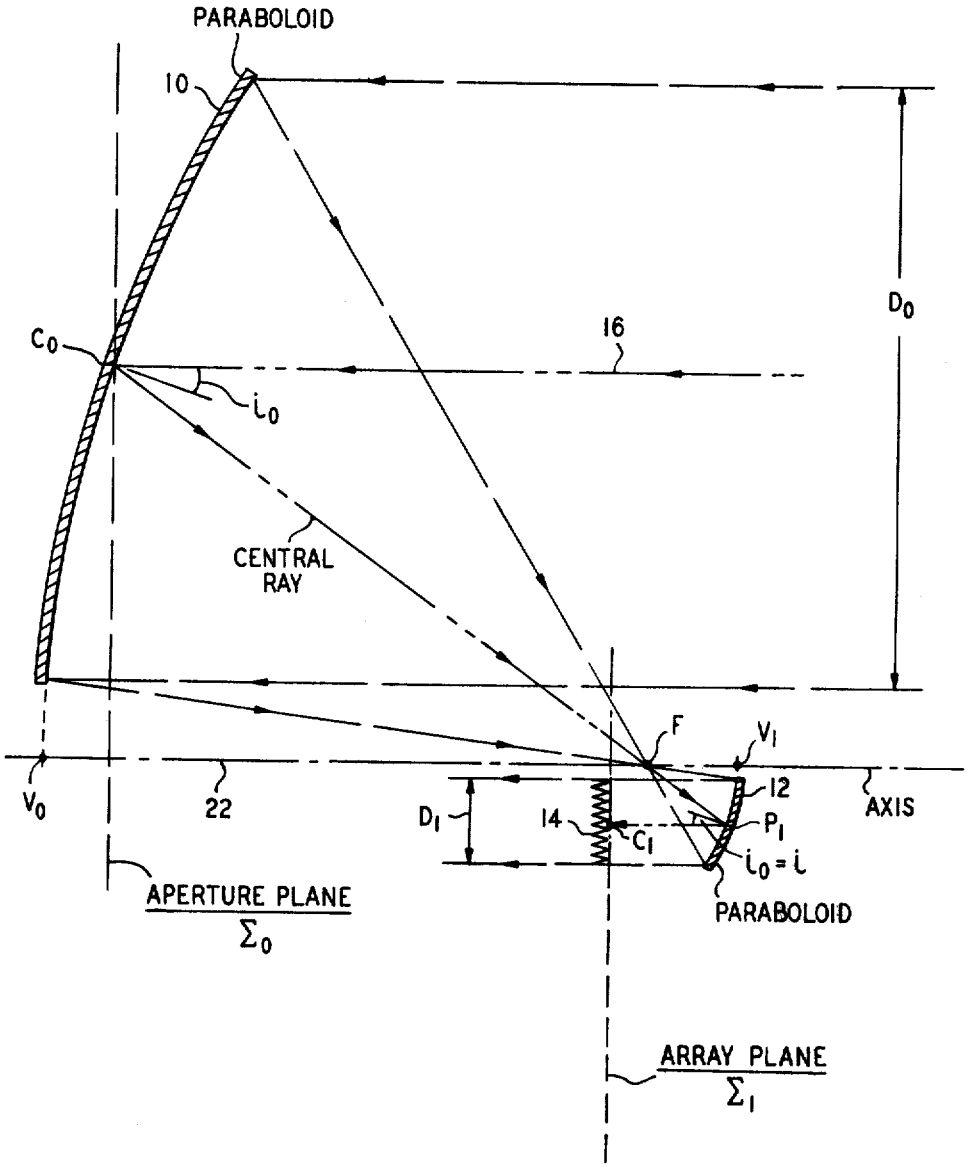
FIG. 1 is a partial side cross-sectional view of a two reflector antenna arrangement with feed array in accordance with the present invention.

Various scanable antenna array arrangements have been suggested which use feed arrays with many elements. The present invention provides for the use of smaller arrays, combined with a Gregorian antenna arrangement, to provide similar results. As shown in FIG. 1, a main parabolic reflector 10 and a parabolic subreflector 12 are arranged confocally and coaxially in an offset configuration so that a magnified image of a small feed array 14 disposed along an array plane $\Sigma_1$ is formed over the aperture of the main reflector 10 along the aperture plane $\Sigma_0$.

It is to be understood that for a magnified image of the feed array 14 to be produced at the aperture of the main reflector, aperture plane $\Sigma_0$ and the array plane $\Sigma_1$ are conjugate planes, and, therefore, the field distribution over aperture plane $\Sigma_0$ is a faithful reproduction of the field distribution on array plane $\Sigma_1$. As a result, a reduction in the array size is achieved over the size of an array that would be needed at aperture plane $\Sigma_0$ without the use of reflectors 10 and 12, by an amount equalling the magnification M achieved by the use of reflectors 10 and 12.

Another important property of the arrangement of FIG. 1 is that relatively large imperfections in the main reflector 10 can be tolerated with little consequence. In fact, a distortion of the main reflector 10 will give rise to a corresponding field distortion at feed array 14 in the array plane $\Sigma_1$, and such distortion can, therefore, be corrected by a corresponding adjustment of the phase distribution of the array elements which are directly affected by the distortions. The required surface accuracy of the main reflector 10 is thus reduced, and, therefore, simplifies its construction. In particular, for use in satellites, an unfoldable reflector of very large size may become feasible since distortions caused by surface non-uniformities can easily be corrected by changes in the phase distribution of feed array 14. For example, the main reflector 10 may consist of separate sections, and their exact alignment is not important since each section is imaged into a different area of the array 14, and, therefore, any displacement of a particular section can be corrected by a corresponding displacement of the array elements that correspond to displaced section, instead of changing the phase distribution of the affected elements of array 14. Additionally, such an antenna may be considered as consisting of several sections, each section having its own feed array. Such an antenna is an example of an array of several elements (reflector sections) each with a relatively narrow beamwidth, e.g., much narrower than 6 degrees, whose combination will scan over the entire field of view as, for example, the United States without grating lobes.

To achieve perfect imaging, which denotes that a planar wavefront launched by the feed array 14 will be reflected by subreflector 12 and main reflector 10 into a planar wavefront at the aperture thereof, and permit surface imperfections in main reflector 10 to be compensated for at the feed array, the various antenna elements have the following relationships. In the arrangement shown in FIG. 1, main parabolic reflector 10 and parabolic subreflector 12 are disposed coaxially and confocally in an offset Gregorian configuration, which by definition require that both focal point F and the axis of main reflector 10 and subreflector 12 correspond. In such arrangement, the location of the array plane $\Sigma_1$, which is the conjugate plane of aperture plane $\Sigma_0$, can be determined in the following manner. Let $C_0$ be the central point of main reflector 10. The central point, $C_1$, of feed array 14 is then positioned on array plane $\Sigma_1$, to correspond with the point where the central ray 16 of a planar wavefront, after being reflected at point $C_0$ and the central point $P_1$ of subreflector 12, intersects array plane $\Sigma_1$. It is to be noted that central ray 16 passes through focus F. The distance $l_1$ which equals magnitude of $C_1P_1$ of array plane $\Sigma_1$ from subreflector 12 is now determinable by requiring that points $C_0$ and $C_1$ be, within the paraxial approximation, conjugate points.

Figure 2:
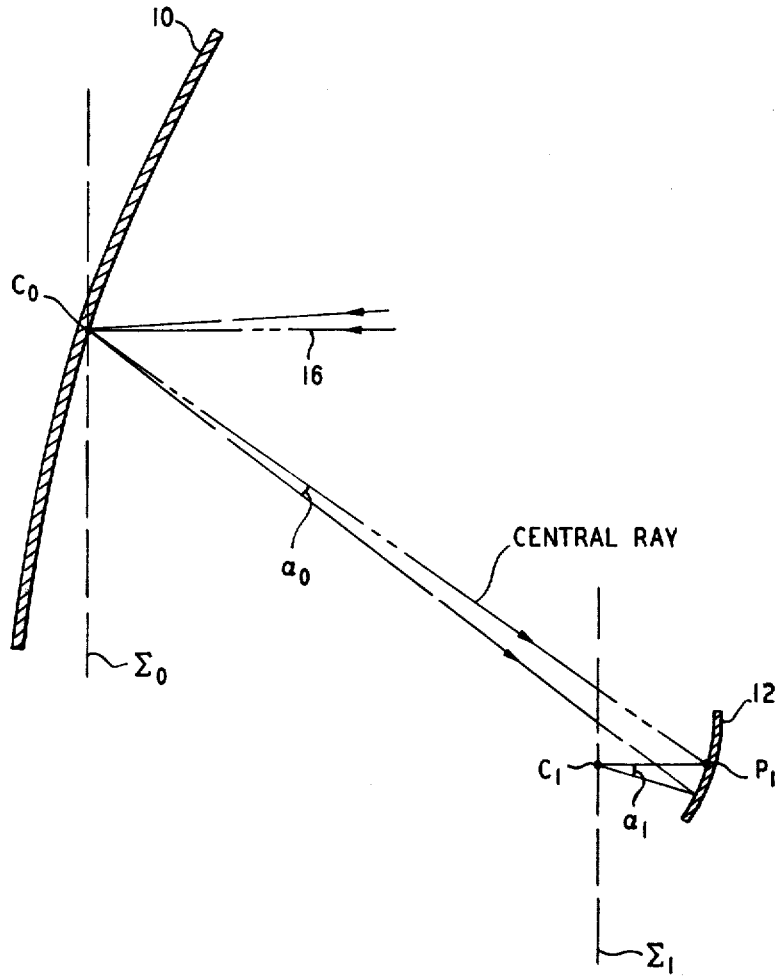
FIG. 2 is a partial side cross-sectional view of the two reflectors of FIG. 1 illustrating the reflected path of two separate rays impinging on the central point of the main reflector from two separate directions.

Under such conditions, a ray incident on the paraboloid main reflector 10 at central point $C_0$, making a small angle $\alpha_0$ with the central ray, as shown in FIG. 2, must be transformed after the two reflections into a ray meeting again the central ray at central point $C_1$ at an angle $\alpha_1$ which can be shown to be given for small $\alpha_1$ by expression $$\alpha_1 = M\alpha_0, \tag{1}$$

M being the magnification given by the ratio between the aperture diameter $D_0$ and the array diameter $D_1$ as given by $$M = \frac{D_0}{D_1} = \frac{f_0}{f_1}, \tag{2}$$

where $f_0$ and $f_1$ are the focal lengths of the two reflectors and correspond to the distance of points $V_0$ and $V_1$ from focal point F, respectively.

From FIG. 2, the arrangement provides that $$l_1\alpha_1 \sim l_0\alpha_0, \tag{3}$$

$l_1$ and $l_0$ being the distances of points $C_1$ and $C_0$ from the point $P_1$ on subreflector 12. It is to be noted that $$l_0 = \frac{f_1 + f_0}{\cos^2 i}, \tag{4}$$

i being the angle of incidence at $P_1$ for the central ray as shown in FIG. 1. From the above relationships, the location of point $C_1$ is obtainable from the expression $$l_1 = \frac{f_1 + f_0}{\cos^2 i}\ \frac{1}{M}, \tag{5}$$

or, $$l_1 = \frac{f_1}{\cos^2 i}\ \frac{M+1}{M} = |FP_1|\ \frac{M+1}{M}. \tag{6}$$

From FIG. 2 it can be seen that a series of rays emanating spherically outward from a point on the reflecting surface of main reflector 10 toward subreflector 12 will recombine at a point on array plane $\Sigma_1$ only because array plane $\Sigma_1$ is a conjugate plane relative to aperture plane $\Sigma_0$. Additionally, from FIG. 1 it can be seen that when a plane wave is reflected by a perfectly shaped parabolic main reflector 10 towards a perfectly shaped parabolic subreflector, disposed confocally and coaxially with the main reflector 10, a planar wavefront is derived at array plane $\Sigma_1$ which is a faithful reduced-size image of the reflecting surface of main reflector 10. From this it can clearly be shown that the present antenna arrangement can provide compensation for deformities in the reflecting surface of main reflector 10 by either appropriately changing the phase distribution or the location of the feed elements of array 14 which are affected by such deformities.

Figure 3:
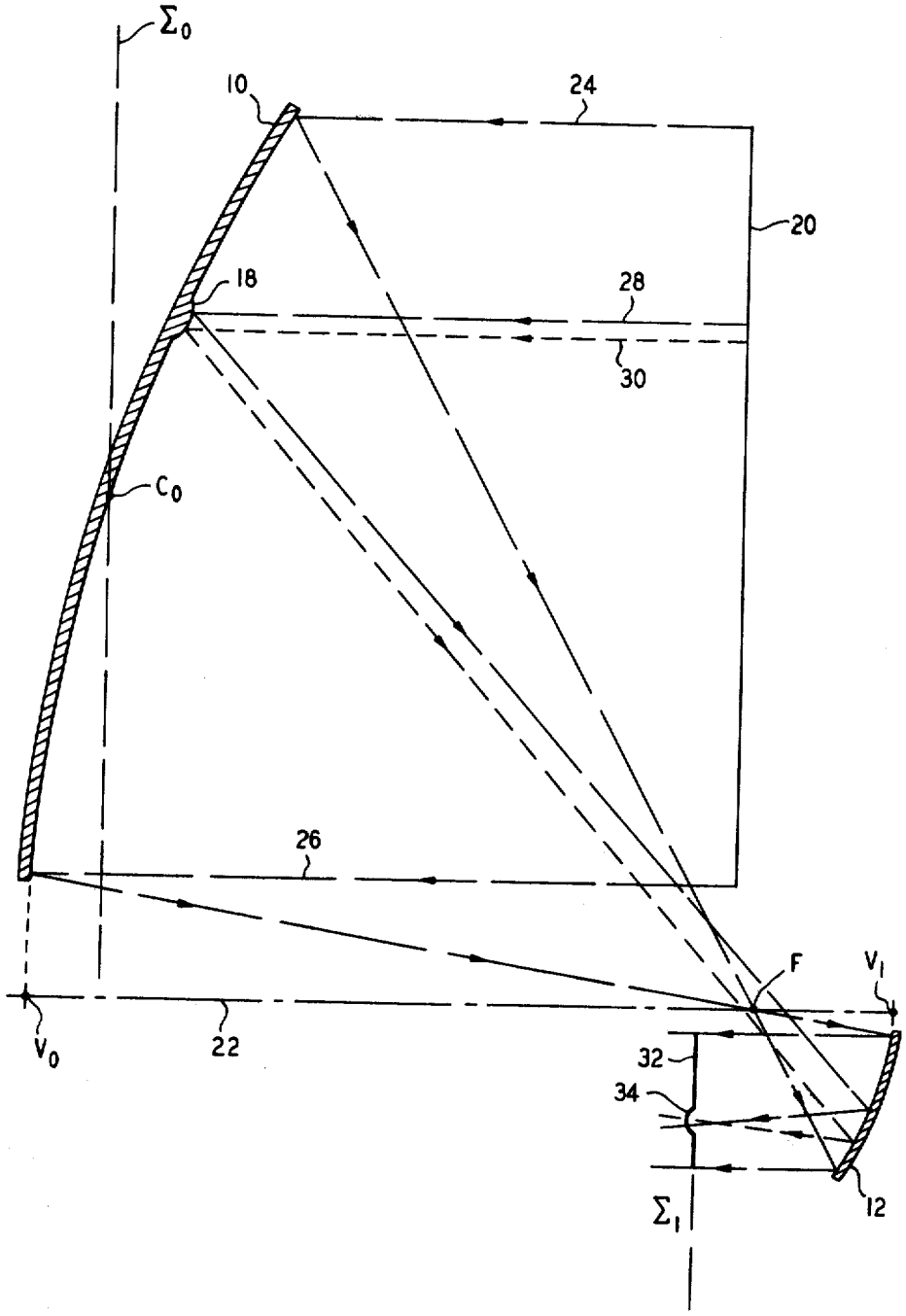
FIG. 3 depicts the arrangement of FIG. 1 illustrating the imaging at the feed array of deformities in the reflecting surface of the main reflector in accordance with the present invention for compensation therefor at the feed array.

For example, in FIG. 3 an imperfection 18 is shown on the reflecting surface of main parabolic reflector 10. As a planar wavefront 20, which is shown propagating towards main reflector 10 perpendicular to the axis 22 thereof, is reflected by main reflector 10 towards subreflector 12, the rays of planar wavefront 20, such as rays 24 and 26, which are reflected from the perfectly formed portions of the parabolic surface of main reflector 10 will pass through focus F, be reflected by subreflector 12, and arrive in phase at array plane $\Sigma_1$. The rays of planar wavefront 20, such as rays 28 and 30, which are reflected by imperfection 18, in accordance with the normal laws of reflection, will not of necessity pass through focus F or even be directed at subreflector 12. Those rays which do impinge on subreflector 12, as shown for rays 28 and 30, will be reflected towards array plane $\Sigma_1$ and arrive at array plane $\Sigma_1$ out of phase with rays 24 and 26 in a manner to provide a phase front 32 which corresponds to an image of the reflecting surface of main reflector 10. As shown in FIG. 3, the phase front 32 at array plane $\Sigma_1$ is planar except for a deformity 34 which can comprise a phase lag or phase lead depending on whether the imperfection in main reflector 10 is concave or convex, respectively.

Figure 7:
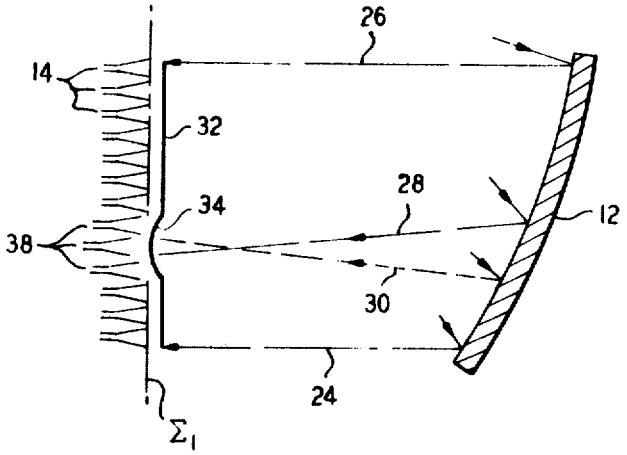
FIG. 7 illustrates a technique for compensating for aberrations in a reflected planar wavefront caused by a deformity in the reflecting surface of the main reflector as shown in FIG. 3 by changing the position of the feed elements of an array at the conjugate array plane which are affected by such aberrations.
Figure 8:
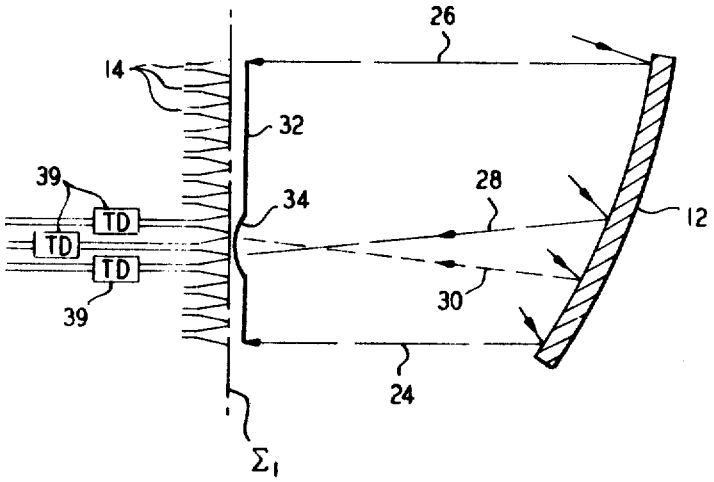
FIG. 8 illustrates another technique for compensating for aberrations in a reflected planar wavefront caused by a deformity in the reflecting surface of the main reflector as shown in FIG. 3 by appropriately altering the phase of the signals of the feed elements of an array at the conjugate array plane which are affected by such aberrations.

To compensate for the phase differences caused by imperfection 18 at deformity 34 and thereby provide a substantially planar received image or transmitted wavefront at the feed array 14 or the aperture of main reflector 10, respectively, either one of the following techniques can now be used. For example, one technique would be to move the feed elements 38 of array 14 associated with the rays at deformity 34 either forward or backward from array plane $\Sigma_1$ by a sufficient amount to compensate for a phase delay or lead, respectively, introduced by imperfection 18 at deformity 34 in the phase front 32 at array plane $\Sigma_1$ as shown in FIG. 7 for the condition where a phase lead is encountered by, for example, an imperfection 18 in the main reflector 10 as shown in FIG. 3. Alternatively, another technique would be to introduce an appropriate time delay 39 in the transmission lines to the various affected feed elements 38 of array 14 as shown in FIG. 8 for the condition where a phase lead is encountered by, for example, an imperfection 18 in the main reflector 10 as shown in FIG. 3 sufficient to overcome deformity 34 of phase front 32 and thereby effectively produce a planar received wavefront or transmitted wavefront at the feed array 14 or aperture of main reflector 10, respectively. Appropriate phase delays can be accomplished by introducing, for example, PIN diode time delay devices in the appropriate transmission lines to the affected feed elements of feed array 14. It is to be understood that where imperfection 18 causes a phase lead at phase front 32 in the area of deformity 34, an appropriate technique can be used via time delay means as shown in FIG. 3 or relocation of the affected feed elements 38 as shown in FIG. 7 at deformity 34 to introduce a phase lag at the feed elements in the area of deformity 34 of phase front 32 or the feed elements not in the area of deformity 34 can be moved forward toward subreflector 12 by an amount sufficient to overcome the phase lead originally encountered at the area of deformity 34. However, where imperfection 18 causes a phase lag at phase front 32 in the area of deformity 34, either the feed elements in the area of deformity 34 can be moved by an appropriate amount toward subreflector 12 or an appropriate time delay can be introduced in each of the transmission lines associated with the feed elements of feed array 14 not in the area of deformity 34 to compensate for the phase difference introduced by imperfection 18 in the reflecting surface of main reflector 10..

Figure 4:
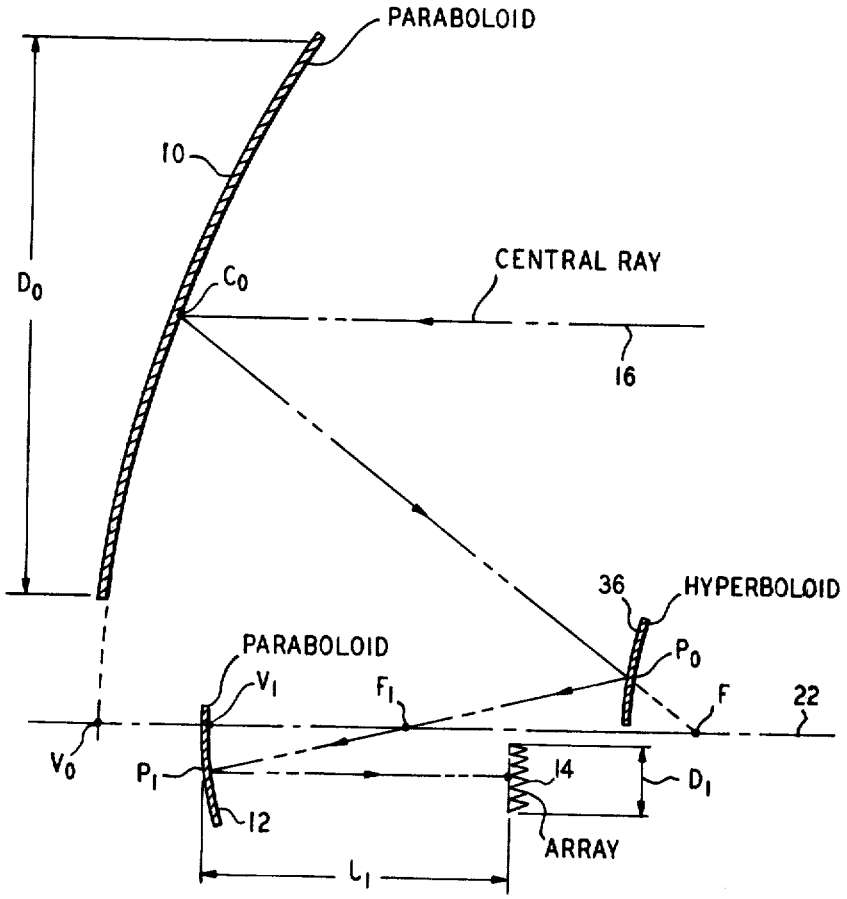
FIG. 4 is a partial side cross-sectional view of a three-reflector arrangement in accordance with the present invention.

Although limited scanning with the present antenna structure can be obtained without aperture blockage such as in a satellite which may require a 3 degrees×6 degrees scanning range for coverage of the continental United States, feed array 14 is positioned relatively close to subreflector 12 which may be disadvantageous for some applications. A greater distance $l_1$ may be needed, for instance, if a grid must be placed between the feed array 14 and the subreflector 12 for polarization and/or frequency diplexing. In this case, it may be advantageous to use a second subreflector 36 with the arrangement of FIG. 1 and arranged between reflectors 10 and 12 as shown in FIG. 4. To determine the distance $l_1 = |C_1P_1|$ of the feed array 14 from the last reflector in the three reflector arrangement, it is convenient to introduce the parameters $l_2, \xi_1, \xi_2, M_0$ which are defined by use of the expressions $$l_2 = |C_0F| \tag{7}$$

$$l_2/\xi_1 = |P_0F| \tag{8}$$

$$M_0 l_2/\xi_1 = |F_1P_0| \tag{9}$$

$$l_2/\xi_2 = |P_1F_1| \tag{10}$$

where F is the focal point of main reflector 10 and one focal point of hyperboloid subreflector 36, $F_1$ is the focal point of paraboloid subreflector 12 and the other focal point of hyperboloid subreflector 36, and $\xi_1$ and $\xi_2$ are values chosen to, inter alia, provide a compact arrangement, minimal blockage, etc.

Figure 5:
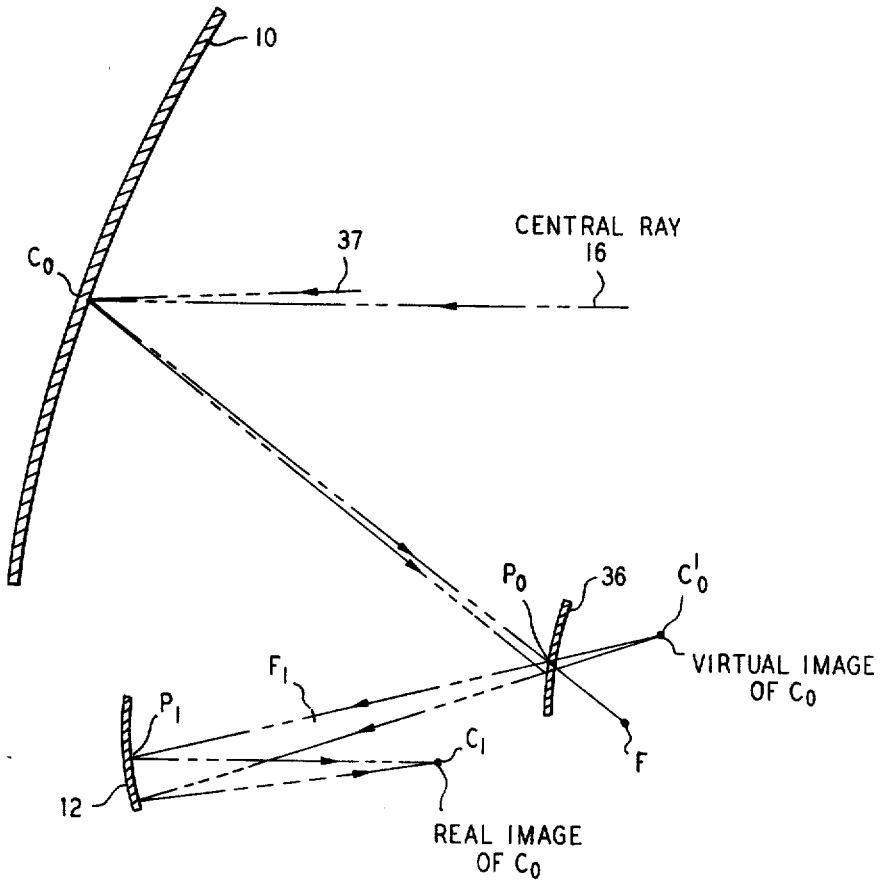
FIG. 5 depicts the antenna arrangement of FIG. 4 and illustrates the reflected path of two separate rays impinging on the central point of the main reflector from two separate directions.

To determine the location of central point $C_1$ on feed array 14, two rays 16 and 37 reflected by the paraboloid main reflector 10 at central point $C_0$ will be considered as shown in FIG. 5. One of the two rays is the central ray 16. It is to be noted that the hyperboloid reflector 36 forms a virtual image $C'_0$ of $C_0$. The parabolic subreflector 12 transforms this virtual image into a real image $C_1$, where both rays 16 and 37 meet after reflection by subreflector 12.

To determine the location of virtual image point $C'_0$ it is necessary to find the paraxial focal length of the subreflector 36. Taking into account that $F_1$ and F are conjugate points, whose distances from subreflector 36 are $l_2/\xi_1$, the paraxial focal length is determined by $$\frac{l_2}{\xi_1} \frac{M_0}{M_0 - 1}. \tag{11}$$

Thus, since the distance of central point $C_0$ from the central point $P_0$ of subreflector 36 is $$l_2 \frac{\xi_1 - 1}{\xi_1} \tag{12}$$

and using the well-known lens equation it becomes possible to find the distance of virtual image point $C'_0$ from central point $P_0$ on subreflector 36 from the relationship $$l_2 M_0 \frac{\xi_1 - 1}{\xi_1} \frac{1}{1 + \xi_1(M_0 - 1)}. \quad (13)$$

The location of central point $C_1$ on feed array 14 is next determined. The paraxial focal length of main reflector 10 is $l_2/\xi_2$, and the distance of virtual image point $C_0$ from subreflector 12 is $$\frac{l_2}{\xi_2} + \frac{l_2 M_0^2}{1 + \xi_1(M_0 - 1)}. \quad (14)$$

Therefore, using once more the lens equation, the distance of central point $C_1$ from the central point $P_1$ on subreflector 12 can be determined from $$l_1 = \frac{l_2}{\xi_2}\left[1 + \frac{1}{M_0^2} \frac{1 + \xi_1(M_0 - 1)}{\xi_2}\right]. \quad (15)$$

By properly choosing $\xi_1$ and $M_0$, which are the parameters specifying the subreflector 36, a relatively large value of $l_1$ can be obtained, as shown by the example of FIG. 4. From the foregoing it can be verified that $$M = D_0/D_1 = M_0\xi_2, \quad (16)$$

which gives $\xi_2$ once magnifications M and $M_0$ are known.

The foregoing discussions have primarily dealt with an antenna arrangement which included two or more reflectors that were arranged coaxially and confocally, with the arrangements for three or more reflectors using sequential confocality wherein the first subreflector 36 is confocal with the main reflector 10 at F, and the second subreflector 12 is confocal with first subreflector 36 at $F_1$, etc. In all cases, however, the feed array is positioned at an array plane $\xi_1$ which is conjugate with respect to the aperture plane $\xi_0$ at main reflector 10. Such arrangements are capable of providing minimal distortion over a limited scanning operation and distortion-free operation at 0 degrees scan angle.

It is to be understood that with the two reflector arrangements shown in FIGS. 1-3 distortions will increase in the transmitted or received reflected wavefronts as the reflectors are moved away from confocality and/or coaxiality. With reference to the three reflector arrangement shown in FIG. 4, however, movement away from coaxiality can be accomplished while still providing performance figure which are comparable to the coaxial and confocal arrangement. To maintain such comparable performance figures, however, requires that the three reflector arrangement have the following configuration as illustrated in FIG. 6.

Figure 6:
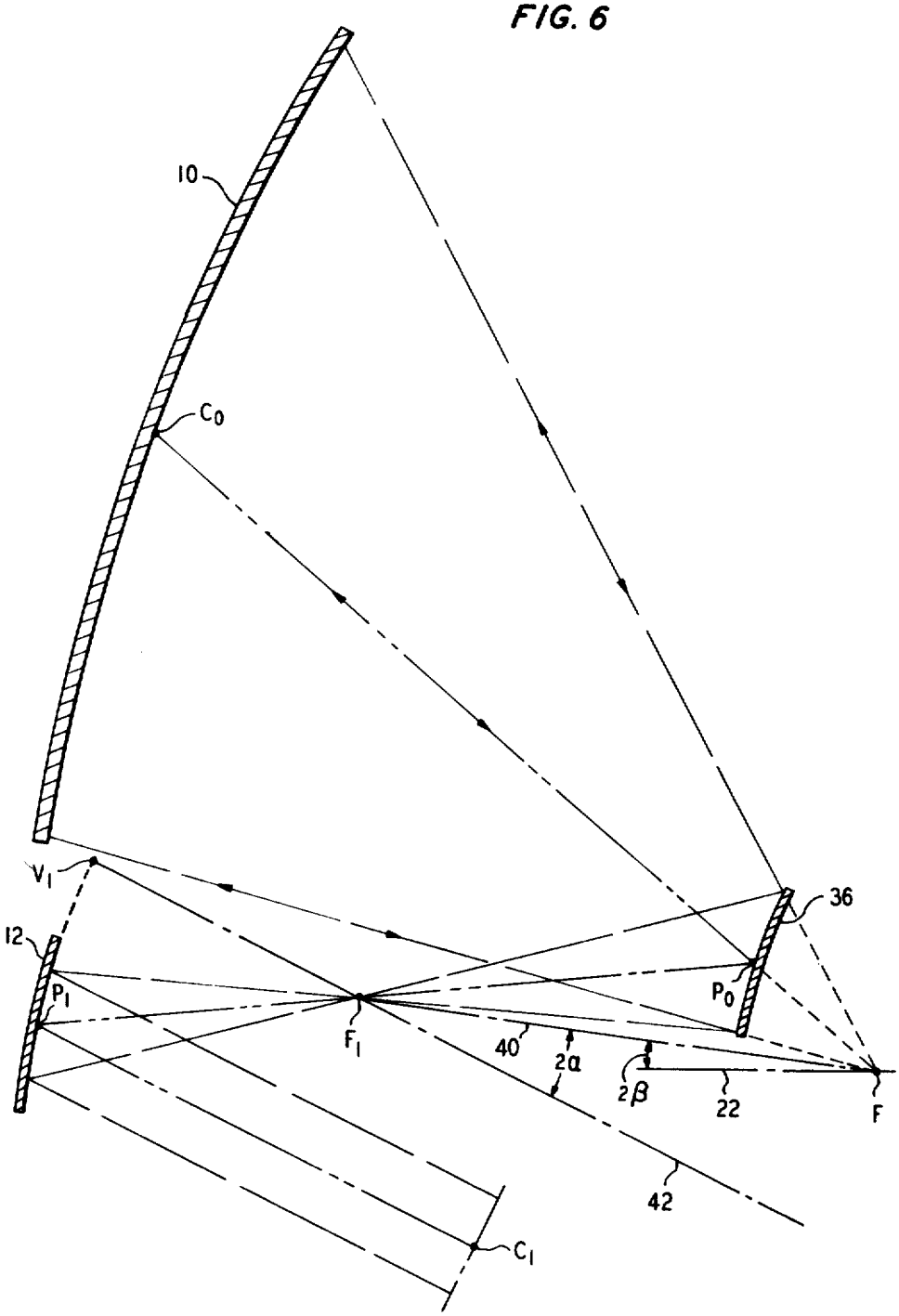
FIG. 6 is the arrangement of FIG. 4 where, in accordance with the present invention, confocality is maintained between the reflectors but where coaxiality of the reflectors is not applied.

In FIG. 6, main parabolic reflector 10, hyperbolic subreflector 36 and parabolic subreflector 12 are disposed in sequential confocality as in FIG. 4 but no longer possess coaxiality. More particularly, the axis 40 of subreflector 36 passes through its foci F and $F_1$ and is displaced from axis 22 of main reflector 10, which also passes through focus $F_1$, by an angle $1\beta$. Subreflector 12 is disposed so that its axis 42 passes through focus $F_1$ and corresponds to the equivalent axis of a single reflector which could replace the combination of main reflector 10 and subreflector 36 and provide the same bidirectional wavefront pattern, as is well known in the art. Axis 42 is displaced from axis 40 by an angle $2\alpha$ and the performance of the arrangement of FIG. 6 will correspond to the performance of the arrangement of FIG. 4 when $$\tan \alpha = m \tan \beta, \quad (17)$$

where m is the magnification of subreflector 36. It is to be noted that the arrangement of FIG. 6 corresponds to the arrangement of FIG. 4 when the angles $2\alpha$ and $2\beta$ equal zero degrees.

Imperfections in the reflecting surface of main reflector 10 can be compensated for at the feed array in manner comparable to that previously outlined hereinbefore for compensation for an imperfection 18 in the reflecting surface of main reflector 10 of the two reflector arrangement of FIGS. 1-3.

It is to be understood that the above-described embodiments are simply illustrative of the principles of the invention. Various other modifications and changes may be made by those skilled in the art which will embody the principles of the invention and fall within the spirit and scope thereof.

We claim:

1. A multiple reflector antenna arrangement comprising a main parabolic reflector (10) comprising a predetermined exit aperture ($D_O$) and a geometric focal point (F);

a parabolic subreflector (12) comprising a geometric focal point (F or $F_1$) and disposed confocally with a next previous reflector along a transmission path of the atenna arrangement in the direction toward the main parabolic reflector from said parabolic subreflector; and a feed array (14) comprising a plurality of feed elements and directed at the parabolic subreflector characterized in that the feed elements of the feed array are disposed substantially on a plane ($\xi_1$) which is a conjugate plane relative to the exit aperture of the main reflector such that a ray incident at a central point ($C_o$) of the main reflector from any direction, when reflected by said main reflector essentially intersects the conjugate plane at said feed array at a central point ($C_1$).

2. A multiple reflector antenna arrangement according to claim 1 characterized in that the parabolic main reflector and the parabolic subreflector are arranged coaxially and confocally with each other.

3. A multiple reflector antenna arrangement according to claim 1 or 2 characterized in that the parabolic main reflector and the parabolic subreflector are disposed in an offset configuration.

4. A multiple reflector antenna arrangement according to claim 1 characterized in that the antenna arrangement further comprises a second focusing subreflector (36) having a first and a second geometric focal point (F and $F_1$), the second subreflector being disposed between the main reflector and the parabolic subreflector along the transmission path of the antenna arrangement and in a manner such that the first and second geometric focal points of the second subreflector correspond to the location of the geometric focal points of the main reflector and the parabolic subreflector, respectively, and the axes of the main reflector and the parabolic and second subreflectors are arranged in accordance with the relationship $$\tan \alpha = m \tan \beta$$

where $2\beta$ is the angle between the axes of the parabolic and second subreflector, m is the magnification of the second focusing subreflector, and $2\beta$ is the angle between the axes of the main reflector and the second subreflector.

5. A multiple reflector antenna arrangement according to claim 4 characterized in that the second focusing subreflector comprises a hyperboloid reflecting surface.

6. A multiple reflector antenna arrangement according to claim 4 characterized in that the main reflector, parabolic subreflector and second focusing subreflector are arranged in an offset configuration.

7. A multiple reflector antenna arrangement according to claims 1, 2, or 4 characterized in that predetermined feed elements of the feed array are disposed slightly away from the conjugate plane in a manner to provide a phase distribution contour along the conjugate plane which negates phase differences introduced in a reflected planar wavefront by imperfections in the reflecting surface of the main reflector.

8. A multiple reflector antenna arrangement according to claims 1, 2, or 4 wherein each feed element of the feed array is connected to a separate feed line capable of bidirectionally propagating signals between the associated feed element and a circuit means characterized in that time delay means are mounted in predetermined ones of the feed lines connected to the plurality of feed elements capable of providing a time delay in signals propagating thereon sufficient to compensate for phase differences which are introduced in a reflected planar wavefront by imperfections in the reflecting surface of the main reflector.

* * * * *